US010477944B2

(12) United States Patent
Bouix et al.

(10) Patent No.: US 10,477,944 B2
(45) **Date of Patent: *Nov. 19, 2019**

(54) HEATING SYSTEM FOR A COSMETIC MASK

(71) Applicant: ELC Management LLC, Melville, NY (US)

(72) Inventors: Herve F. Bouix, New York, NY (US); Christophe Jacob, Franqueville-Saint-Pierre (FR)

(73) Assignee: ELC MANAGEMENT, LLC, Melville, NY (US)

( * ) Notice: Subject to any disclaimer, the term of this patent is extended or adjusted under 35 U.S.C. 154(b) by 303 days.

This patent is subject to a terminal disclaimer.

(21) Appl. No.: 15/383,554

(22) Filed: Dec. 19, 2016

(65) Prior Publication Data

US 2017/0095057 A1 Apr. 6, 2017

Related U.S. Application Data

(62) Division of application No. 14/309,382, filed on Jun. 19, 2014, now Pat. No. 9,560,907.

(51) Int. Cl.

| | |
|---|---|
| ***H05B 3/34*** | (2006.01) |
| ***A45D 40/00*** | (2006.01) |
| ***A45D 40/18*** | (2006.01) |
| ***H05B 3/00*** | (2006.01) |
| ***H05B 3/14*** | (2006.01) |

(Continued)

(52) U.S. Cl.

CPC ..... *A45D 40/18* (2013.01); *A45D 34/04* (2013.01); *A45D 40/0087* (2013.01); *A45D 44/002* (2013.01); *B65D 75/30* (2013.01); *B65D 75/52* (2013.01); *H05B 3/0014* (2013.01); *H05B 3/145* (2013.01); *H05B 3/146* (2013.01); *H05B 3/34* (2013.01); *A45D 2200/1027* (2013.01); *A45D 2200/155* (2013.01); *A45D 2200/25* (2013.01); *H05B 2203/005* (2013.01);

(Continued)

(58) Field of Classification Search

None

See application file for complete search history.

(56) References Cited

U.S. PATENT DOCUMENTS 2,699,779 A * 1/1955 Lustig ..... A61F 7/02 206/210
3,573,430 A * 4/1971 Eisler ..... B65D 81/3476 219/385

(Continued)

FOREIGN PATENT DOCUMENTS

CN 2899561 Y 5/2007
CN 102160911 A 8/2011

(Continued)

OTHER PUBLICATIONS

Chinese search report from counterpart CN application.

*Primary Examiner* — Joseph M Pelham
(74) *Attorney, Agent, or Firm* — Peter Giancana

(57) ABSTRACT

A heating system comprising a packette for heating a mask, wipe or towelette. In preferred embodiments, the packette comprises printed heating elements, printed circuit elements and a means of connecting to a power source. Power may be supplied through a USB-type connector or a handheld power supply that is custom designed to work with the heating packette.

3 Claims, 12 Drawing Sheets

(51) Int. Cl.

| | |
|---|---|
| ***A45D 34/04*** | (2006.01) |
| ***A45D 44/00*** | (2006.01) |
| ***B65D 75/30*** | (2006.01) |
| ***B65D 75/52*** | (2006.01) |

(52) U.S. Cl.
CPC .. *H05B 2203/013* (2013.01); *H05B 2203/016* (2013.01); *H05B 2203/02* (2013.01)

(56) References Cited

U.S. PATENT DOCUMENTS 3,829,654 A * 8/1974 Eisler ..... A47J 36/022 219/386
3,879,171 A * 4/1975 Tulis ..... A61L 2/20 219/212
4,087,675 A * 5/1978 Sansonetti ..... H05B 3/342 2/158
4,163,896 A * 8/1979 McAvinn ..... A61F 15/00 219/525
4,437,567 A * 3/1984 Jeng ..... B65D 81/24 206/210
4,761,541 A * 8/1988 Batliwalla ..... H01C 7/027 219/528
4,777,351 A * 10/1988 Batliwalla ..... H01C 7/027 219/528
4,912,306 A * 3/1990 Grise ..... H05B 3/34 219/543
5,486,680 A * 1/1996 Lieberman ..... H01M 2/1066 2/905
6,222,160 B1 * 4/2001 Remke ..... A45C 11/20 219/387
6,599,657 B1 * 7/2003 Pollett ..... H01M 2/1005 29/623.1
6,726,386 B1 * 4/2004 Gruenbacher ..... A01N 25/34 15/104.94
7,021,848 B1 * 4/2006 Gruenbacher ..... A47L 13/19 126/263.08
7,022,950 B2 * 4/2006 Haas ..... A41D 13/0051 219/212
7,108,440 B1 * 9/2006 Gruenbacher ..... A47L 13/19 15/227
7,182,739 B2 * 2/2007 Kopanic ..... A61F 7/03 601/15
7,255,506 B2 * 8/2007 Gruenbacher ..... A01N 25/34 15/227
8,336,738 B2 * 12/2012 Bouix ..... A45D 34/00 219/628
9,173,471 B2 * 11/2015 Inoue ..... A45D 34/046
9,560,907 B2 * 2/2017 Bouix ..... A45D 40/18
9,565,918 B2 * 2/2017 Bouix ..... A45D 40/0087
2002/0014485 A1 * 2/2002 Fernando ..... B01F 1/00 219/543
2003/0102296 A1 * 6/2003 Nelson ..... B60N 2/5685 219/217
2005/0224388 A1 * 10/2005 Saric ..... F24V 30/00 206/554
2008/0097356 A1 * 4/2008 Donovan ..... A61K 8/0208 604/291
2008/0261441 A1 * 10/2008 Shih ..... B65H 75/4431 439/501
2009/0032516 A1 * 2/2009 Reasor ..... B65D 81/3897 219/201
2009/0114633 A1 * 5/2009 Naylor ..... H05B 1/0236 219/213
2012/0138595 A1 * 6/2012 Watakabe ..... H05B 3/34 219/528
2012/0193344 A1 8/2012 Chen
2014/0231410 A1 * 8/2014 Rothschild ..... B62B 9/00 219/480
2015/0366322 A1 * 12/2015 Bouix ..... A45D 40/18 206/581

FOREIGN PATENT DOCUMENTS

CN 103569475 A 2/2014
GB 900517 A * 7/1962 ..... A47J 36/10

* cited by examiner

HEATING SYSTEM FOR A COSMETIC MASK

FIELD OF THE INVENTION

The invention concerns textile substrates that are used to deliver cosmetic and personal care treatments. More specifically, the invention is directed to heated cosmetic and personal care masks and wipes.

BACKGROUND

Woven and non-woven fabrics that are impregnated with a cosmetic or personal care preparation are well known. These include what are known as wipes, towelettes and masks. (For simplicity, in the remainder of the specification we will use the terms "mask" or "mask-type product" to refer to wipes, towelettes, and masks.) Cosmetic and personal care masks are a popular means of delivering a product to the skin and/or for removing substances from the skin. A stack of masks is sometimes packaged in a single container. Alternatively, a single mask may be packaged in a sealed pouch, such as a packette. Individual packaging reduces the chance of contamination, and makes the masks more portable. Masks are usually intended for one use. Therefore, once the packette is opened and the mask is removed, the packette may be discarded.

A cosmetic or personal care mask generally covers a large area, such as the whole face, the hand or a baby's bottom. Therefore, to fit in a packette, the mask is usually folded one or more times. A basic packette is made conventional paper webs that are coated to prevent oil absorption. Alternatively, plastic laminates and foil laminates are also used. A typical packette for a mask product may comprise a sheet having first and second panels which are able to fold against each other, and bond along the perimeter of the panels. Bonding may be achieved by a continuous line of adhesive or welding, for example. A reservoir for the mask is defined between the bonded panels. A means for opening the packette to retrieve the mask from the reservoir is usually provided. For example, a pull tab may be located along a weaker section of the packette. Typical packettes are basically rectangular or square, and measure 25-150 mm on a side, while larger packettes, and differently shaped packettes are also known. In general, packettes are relatively flat. The two opposing panels may be decorated by any suitable means known in the packaging arts, such as ink printing. Sometimes, the packette materials are treated to impart an improved quality to finished packette. For example, foil packettes may be treated to make the foil less permeable to air and water. Plastic packettes may be treated to prevent yellowing of the packette material. Many types of treatment are known for application to either the inside or the outside of the packette.

Nowadays, personal care companies seek to attract consumers by incorporating a source of heat into the cosmetic or personal care experience. A system for heating mask type products that is convenient and portable meets a real consumer need and provides a market advantage. The present invention addresses this need.

OBJECTIVES

A main objective is to provide a simple means for heating an individual mask, wipe or towelette, while it is still disposed in a packette.

Another objective is to provide a mask-type product that can be heated anywhere, without connecting to a power grid or electric mains.

SUMMARY

The present invention comprises a disposable packette that contains a fabric mask (or wipe or towelette) that is impregnated with a cosmetic or personal care product. One or more outer surfaces of the packette comprise printed heating elements, printed circuit elements and a means of connecting to a power source. The packette is designed to be used away from the home, and without connecting to a power grid.

DETAILED DESCRIPTION

By "single-use" packette, we mean a packette without a means to reseal the packette after it has been opened by a user. Preferred single-use packettes hold exactly one cosmetic or personal care mask, towelette or wipe. Hereinafter, "packette" means "single-use packette", unless otherwise stated.

By "comprise", we mean that a group of elements is not limited to those explicitly recited, but may or may not include additional elements.

The Heating Packette

Figure 1:
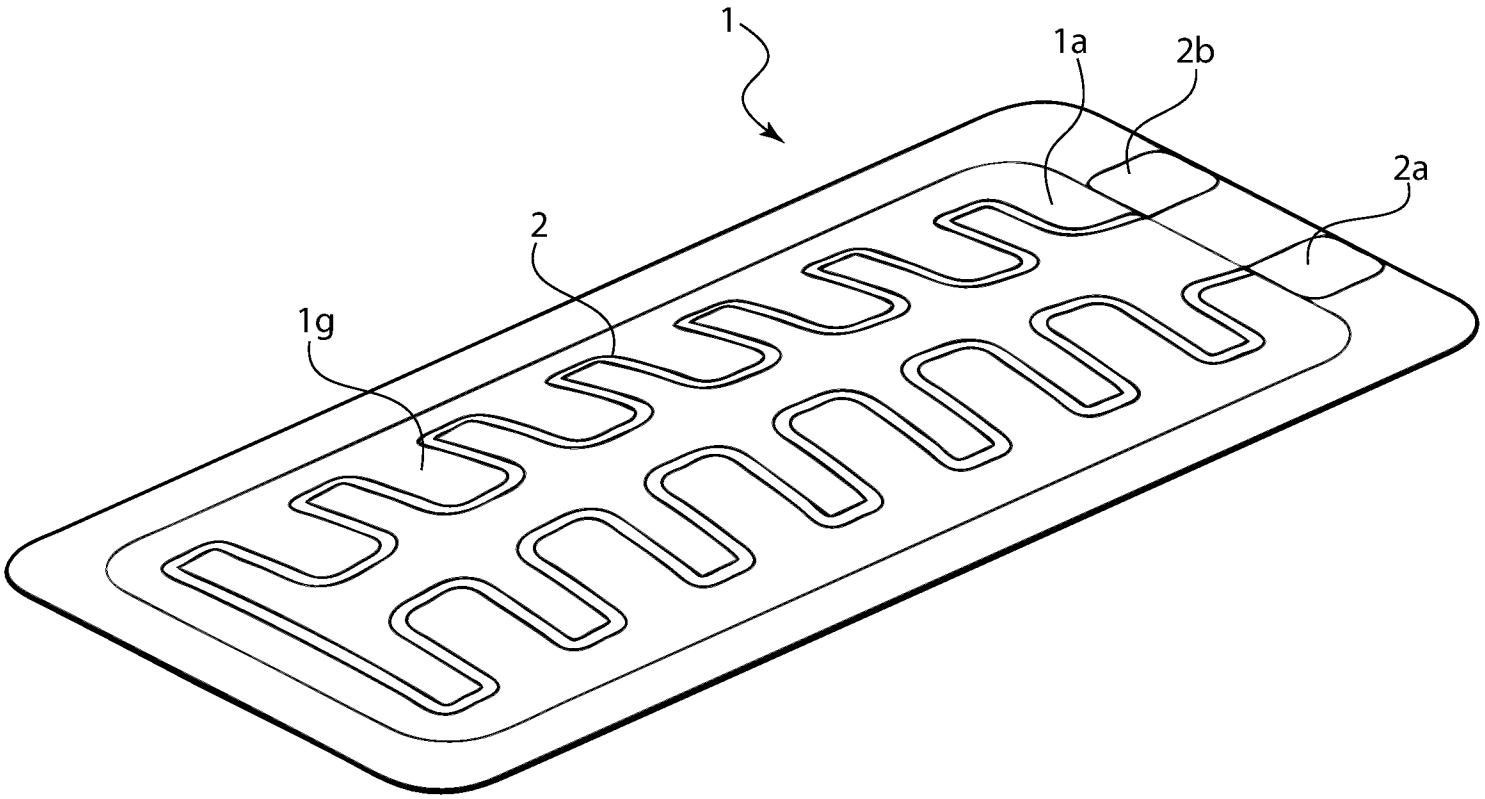
FIG. 1 is perspective view of one embodiment of a heating packette of the present invention.
Figure 2:
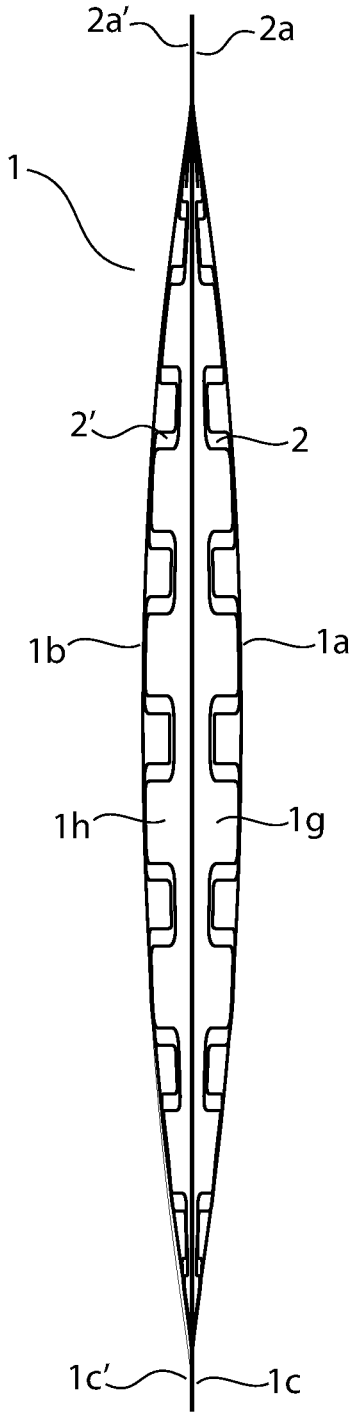
FIG. 2 is a side elevation view of a second embodiment of a heating packette of the present invention.
Figure 3:
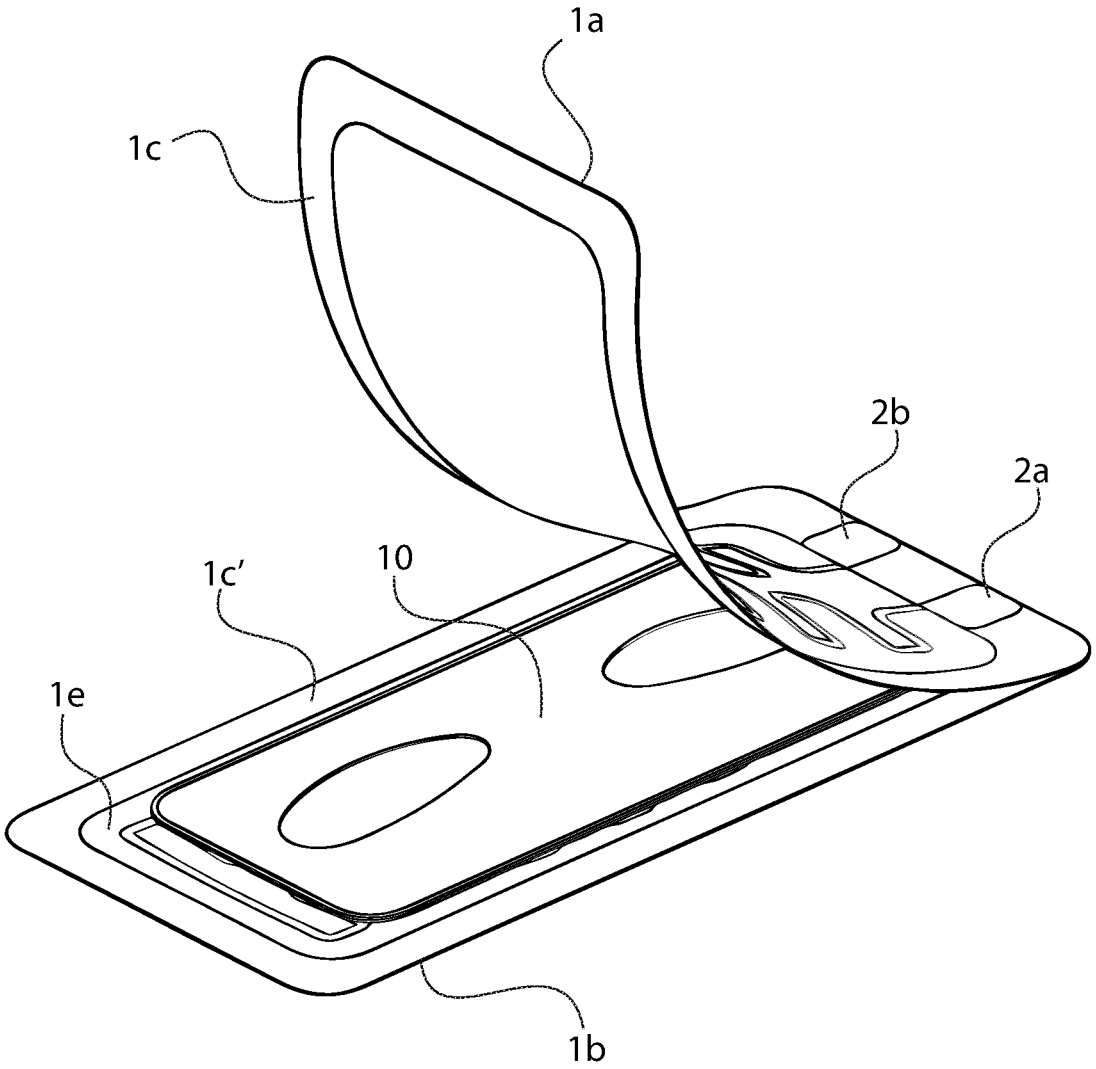
FIG. 3 depicts the packette partially opened to reveal a cosmetic mask on the inside.

Referring to FIGS. 1-3, a packette (1) according to one embodiment of the present invention comprises top and bottom panels (1*a*, 1*b*). Each panel has a respective perimeter portion (1*c*, 1*c*'). The perimeter portions are bonded together, thus forming a reservoir (1*e*) that is sealed off from the ambient environment. A cosmetic mask (10) is disposed in the reservoir prior to sealing. Bonding may be achieved by a continuous line of adhesive or welding, such as sonic welding, for example. Preferably, the seal is airtight to protect the contents of the packette from dry-out and contamination. The seal may be permanent or semi-permanent. If the seal is permanent, then a means must be provided for opening the packette to remove the mask. For example, a tearing zone or pull tab may be located along a weaker section of the packette. Alternatively, if the seal is semi-permanent, then the panels of the packette may be peeled apart, as shown in the figures. A semi-permanent seal may be achieved with pressure sensitive adhesive, and may be resealable.

The packette construction may comprise one material, or a stack, or laminate of different materials. Some useful examples of packette materials include films of polyethylene (PE; low, medium and high density); polyethylene terephthalate (PET); polypropylene (PP); ethylene vinyl acetate (EVA); polybutylene (PB); vinyls; polyesters; styrene polymers; nylon; polycarbonate; acrylics; acrylonitriles; fluoropolymers; cellophane; and aluminum foil. Laminates of these may also be used. For example, a packette comprising an external layer of PET and an internal layer of low density polyethylene (LDPE), is useful for the invention. Laminates that include aluminum foil to increase heat transfer through the packette are also useful. One example of this is PET12/Alu09/PET12/PE75. Most panel constructions are opaque, but one example of a transparent laminate that could be used for the panels is PET12/PET12 coated with silicon oxide/PE75. In this case, the mask inside the packette would be visible from the exterior.

Heat transfer through the panels (1*a*, 1*b*) of the packette (1) is a function of the thickness of the panels. Therefore, the actual thickness of the panels should be chosen based on the rate of heat transfer and the desired length of time to heat the mask (10). The thicknesses of the panels (1*a*, 1*b*) of the packette (1) may typically be on the order of about 100μ to 250μ; preferably 100μ to 200μ; more preferably 100μ to 150μ. Packette laminates are usually chosen for their enhanced barrier properties, such as low gas permeability and moisture protection. However, for use in the present invention, we should also consider a laminate's ability transfer heat as well as its ability to accept inks used in printed circuitry.

Also, heating of a mask (10) in a packette (1) will be more even and efficient when there is a minimum of empty space. Therefore, it is preferable if the length and width of the reservoir (1*e*) are able to accommodate the mask, but the reservoir is not much larger than the mask that it contains. A reservoir may be generally rectangular (possibly square), and measure 25 mm-150 mm by 25 mm-150 mm. The packette will be only slightly larger than the actual length and width of the reservoir. Also, a reservoir should be shallow so that the interior surfaces of the top and bottom panels (1*a*, 1*b*) of the packette lay flat against the top and bottom of the mask. This will give the most area of contact between the mask and packette, and most transfer of heat to the mask.

Heating a single mask inside a packette is unlike heating a larger quantity of product in a reservoir (for example heating a mascara product in a saleable size container). In that situation, the volatile components of the product are lost more quickly each time the product in the reservoir is heated and exposed to the ambient atmosphere. Product dry-out is a serious problem to the marketing of such products. However, in the present invention, when used as directed, product dry-out is not a realistic problem, because the mask is heated only once, and the heating time is, in general, too short to adversely affect the product, which is in a sealed package during heating. Thus, even when the product impregnated into the mask comprises volatile ingredients, there is not sufficient time for the product to be significantly deteriorated by heating, even after the packette is opened.

At least one heating element (2) is in physical contact with at least one of the panels (1*a*, 1*b*) of the packette (1). As heat is generated in the heating element(s), some of the heat makes its way to the mask (10) in the reservoir (1*e*), thereby raising the temperature of the mask and the product that is holds. In one embodiment (FIG. 1) a heating element (2) is located on the exterior surface (1*g*) of exactly one of packette panels (1*a*). In this case, the mask is only heated from one side. More preferably (see FIG. 2), heating elements (2, 2') are located on each of the exterior surfaces (1*g*, 1*h*) of the packette panels (1*a*, 1*b*). In this case, the mask inside the reservoir is heated from both sides, which is faster.

Figure 4:
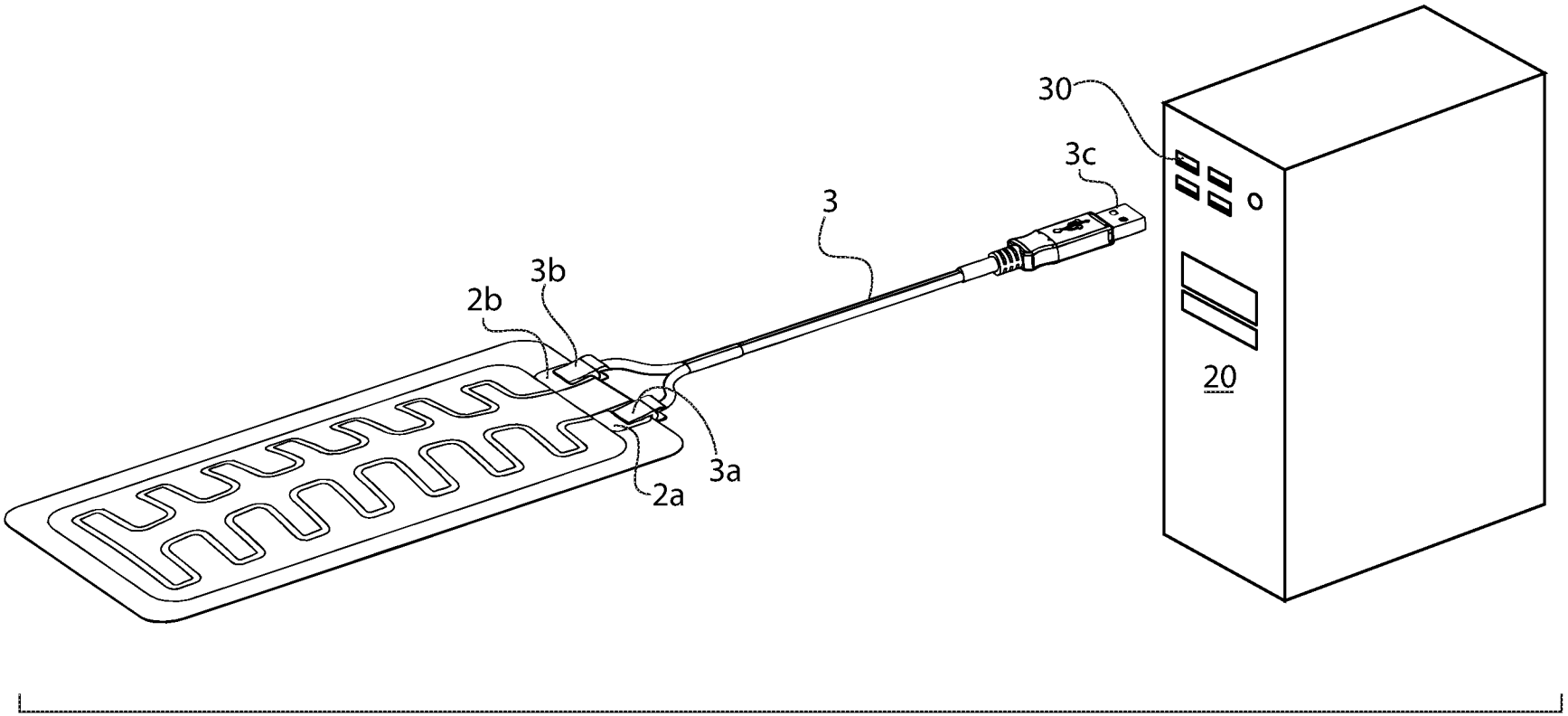
FIG. 4 is a perspective view of a first embodiment of a packette heating system wherein a USB type connector is attached to a packette to provide electrical power.
Figure 5:
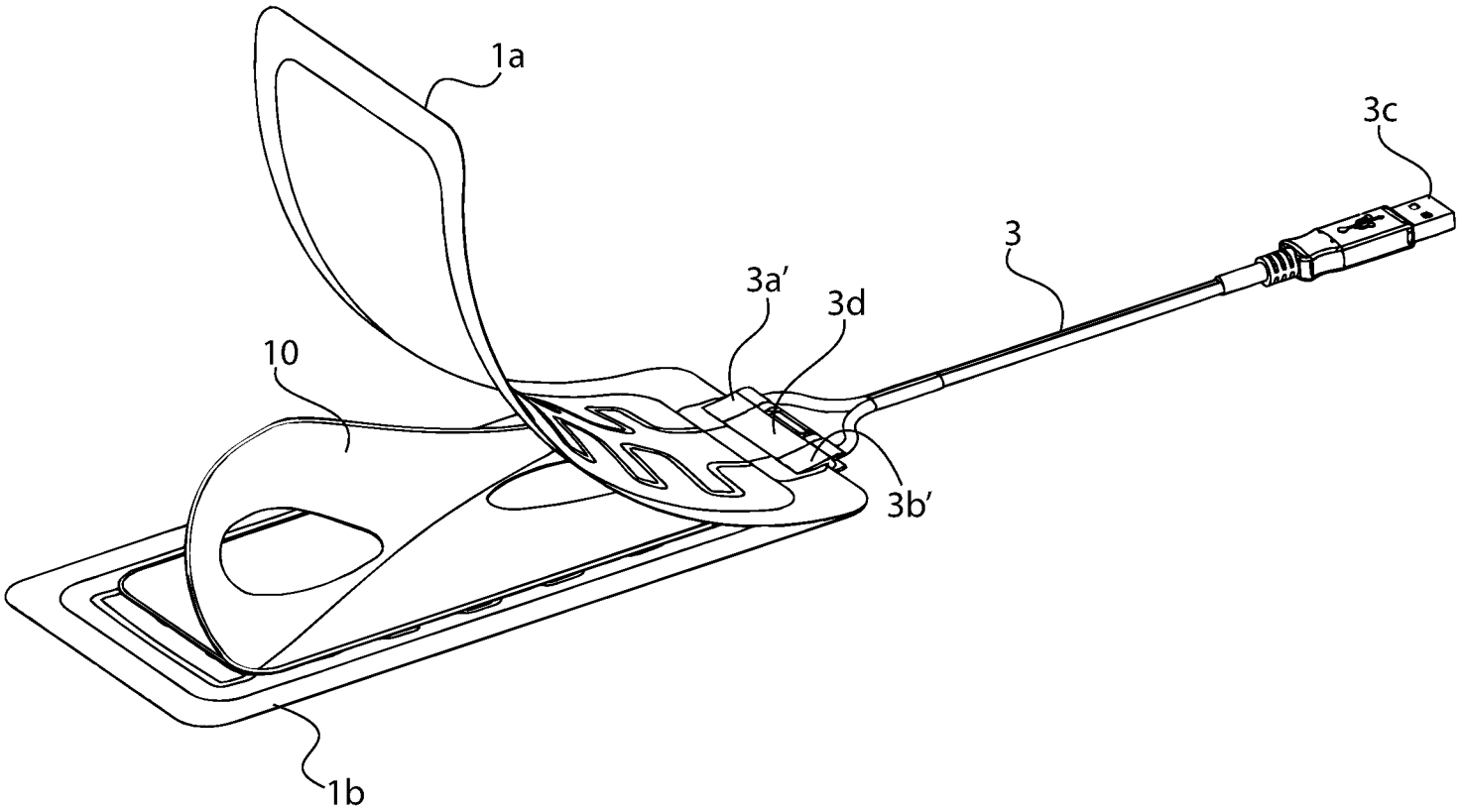
FIG. 5 is the same as FIG. 4, except the packette is partially opened to show a cosmetic mask inside.
Figure 6:
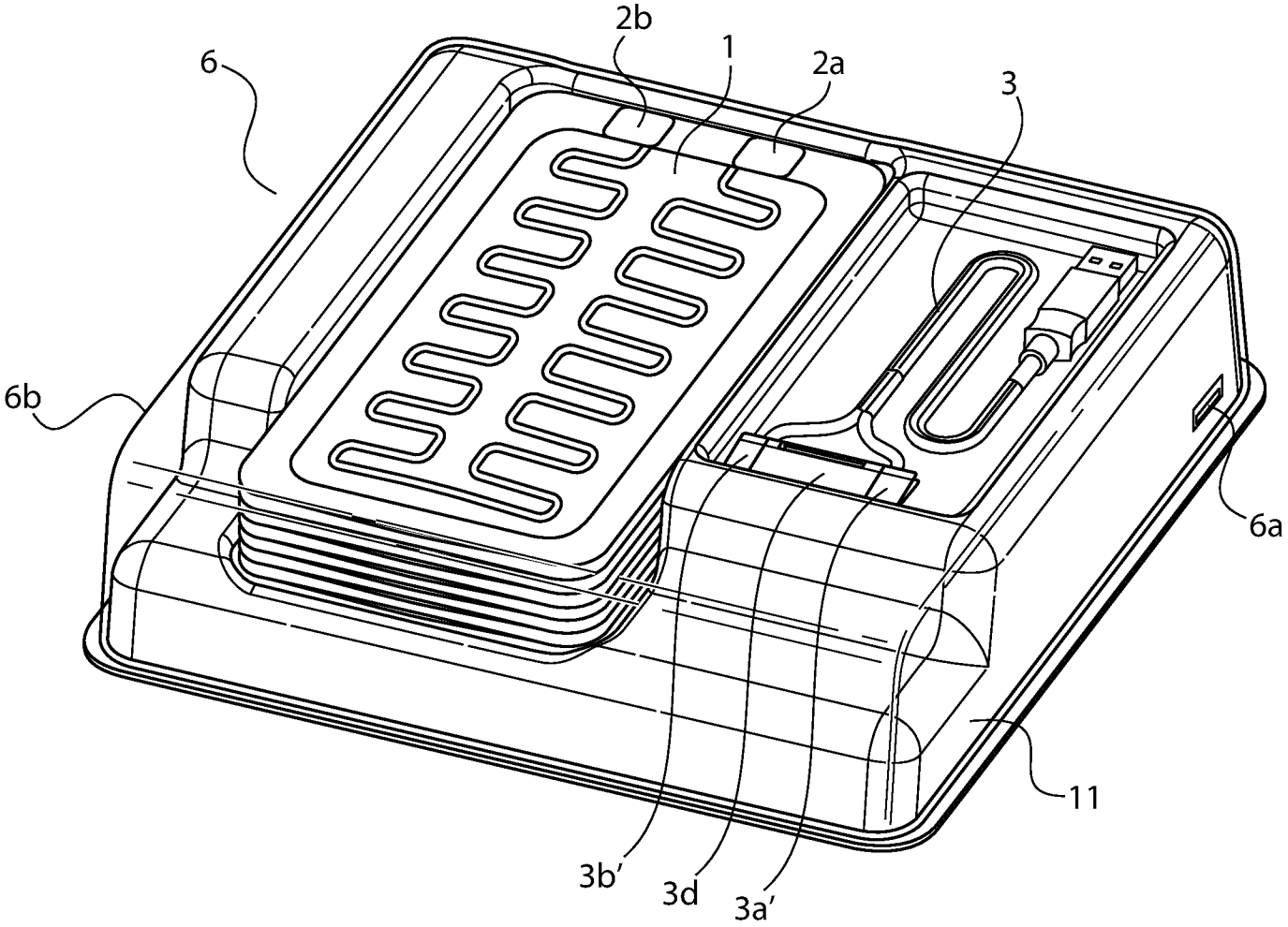
FIG. 6 depicts a kit that comprises multiple packettes containing a cosmetic mask, and a USB-type connector to be used in heating the masks.

In one embodiment, a heating element (2) is formed as a continuous electric path that has a positive terminal (2*a*) and a negative terminal (2*b*) located on or near the perimeter portion (1*c*) of that panel on which the heating element is located. The resistive electric path loops over the panel of the packette to generate heat evenly over the panel. An external power source may be connected to the resistive path of the packette through power leads, thus completing a heating circuit. Preferably, the connection can be established and removed at will. For example, the connection may be achieved with metal clamps (3*a*, 3*b* in FIGS. 4, 5), such as alligator clips or other spring-loaded clips. Electricity from a source external to the packette arrives at one terminal, passes through the circuit where electrical resistance generates heat, and leaves at the other terminal. If there is a second heating element (2') on the other side of the pouch (see FIG. 2), then that element may terminate at the same positive and negative terminals (2*a*, 2*b*) by wrapping around the edge of the packette. Alternatively, a second set of positive and negative terminals (2*a*', 2*b*') may be provided at the ends of the second heating element, preferably opposite the first set of terminals (2*a*, 2*b*). This way, connecting the heating element on one side of the packette automatically connects the heating element on the other side of the packette. Otherwise, separate connections must be provided. In FIGS. 5 and 6 the metal clips (3*a*', 3*b*') are shown as two parts of one clamp separated by an insulating portion (3*d*). The spacing of clips is designed to match the spacing of the positive and negative terminals (2*a*, 2*b*) of the packette (1). Alternatively, in FIG. 4, the metal clips (3*a*, 3*b*) are not joined, and remain free of each other.

Connection to Power Source

The heating packette requires an electrical connection to a power source. The connection must be such that it can be established and removed at will (hereinafter, a "removable" connection to power). The present invention includes electric power leads that are designed to cooperate with the heating packette. One embodiment is shown in FIG. 4 where power cable (3) comprises metal clamps, such as spring loaded clips (3*a*, 3*b*), at one end, and a USB-type connector (3*c*) at the other end. In this embodiment, the heating packette may be powered by connecting the USB-type connector to a charging device having a complementary USB jack (30), such as a computer (20), automobile console, courtesy outlet in a bus or plane, or other device that can provide low voltage electric power. Once contact is established between the spring loaded clips (3*a*, 3*b*) and the positive and negative terminals (2*a*, 2*b*) of the packette heating element, a heating circuit is completed (i.e. closed) and electricity will flow from the charging device, through the heating elements of the packette and back to the charging device. While this is happening, heat is generated, and the interior of the packette is heated. When the clips are removed, then the circuit is opened, and heating stops.

Figure 7:
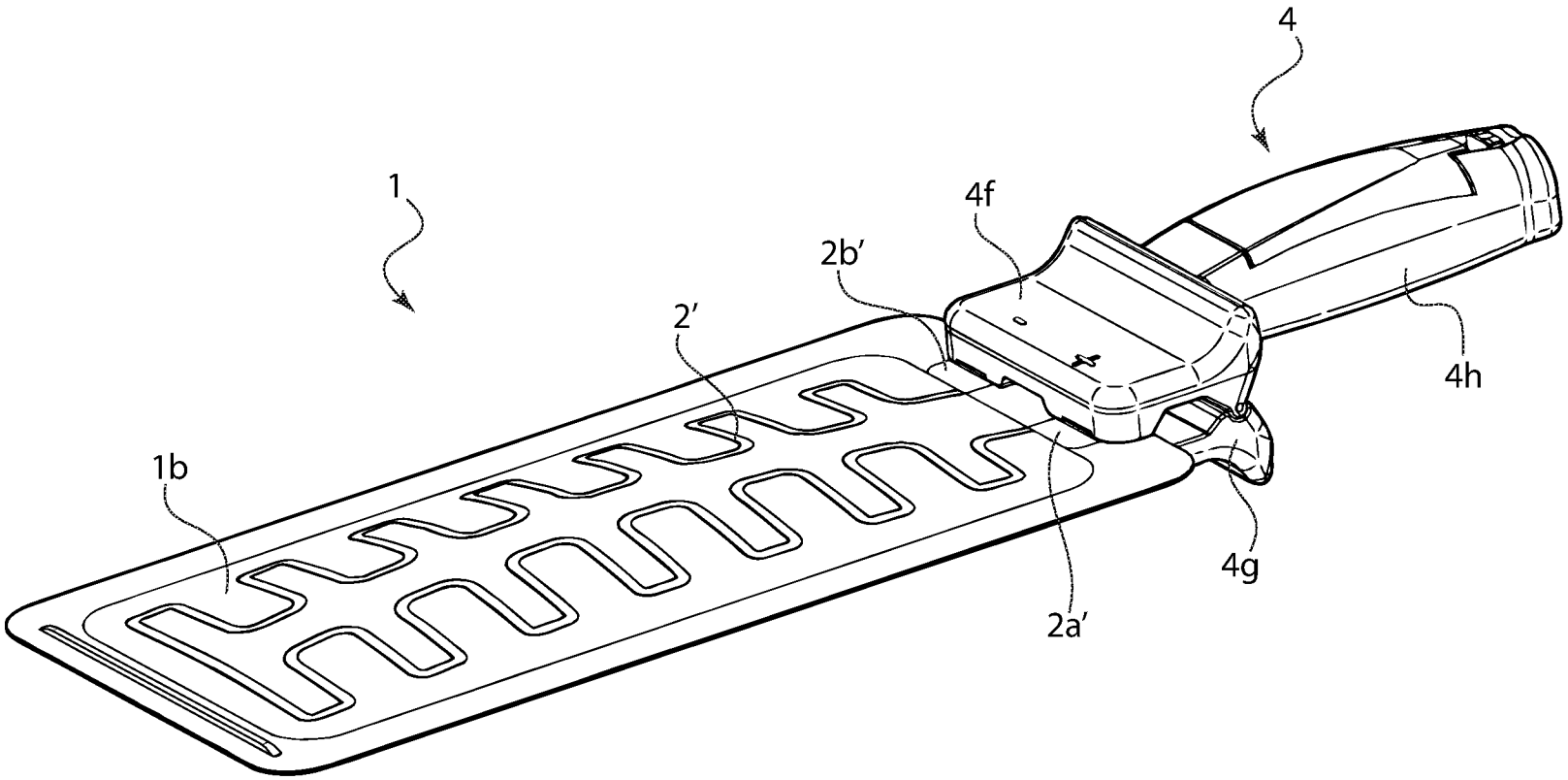
FIG. 7 is a perspective view a second embodiment of a packette heating system wherein power tongs are clipped on to a packette that has a cosmetic mask sealed inside.
Figure 8:
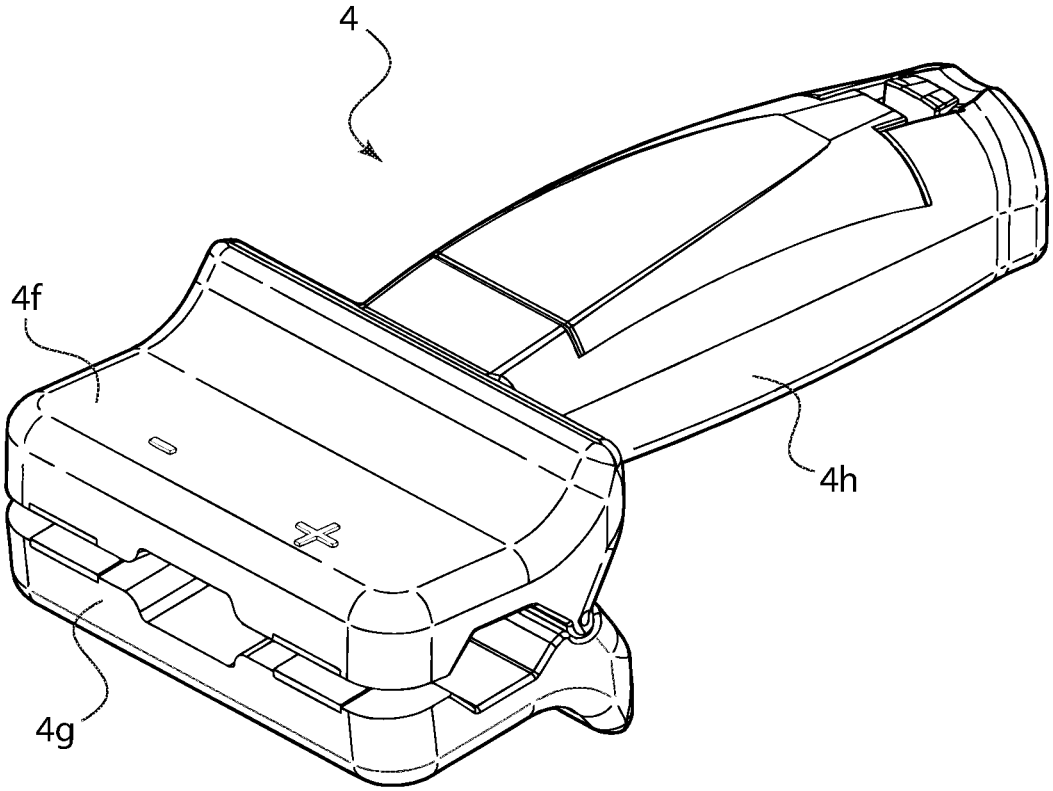
FIG. 8 shows one embodiment of a set of clip on power tongs for use with a heating packette of the present invention. The jaws of the tongs are shown in a opened position.
Figure 9:
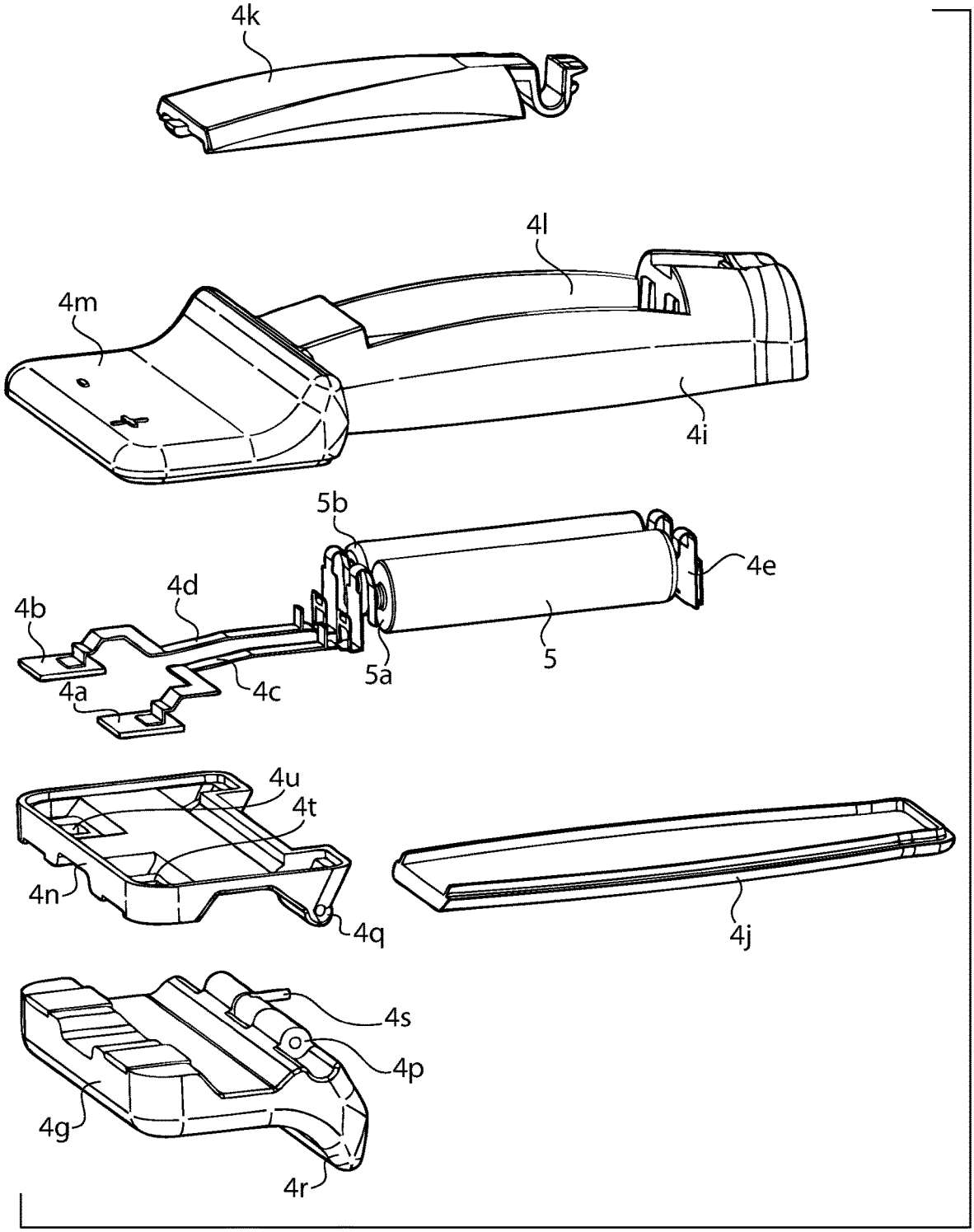
FIG. 9 is an exploded view of the power tongs of FIG. 8.
Figure 10:
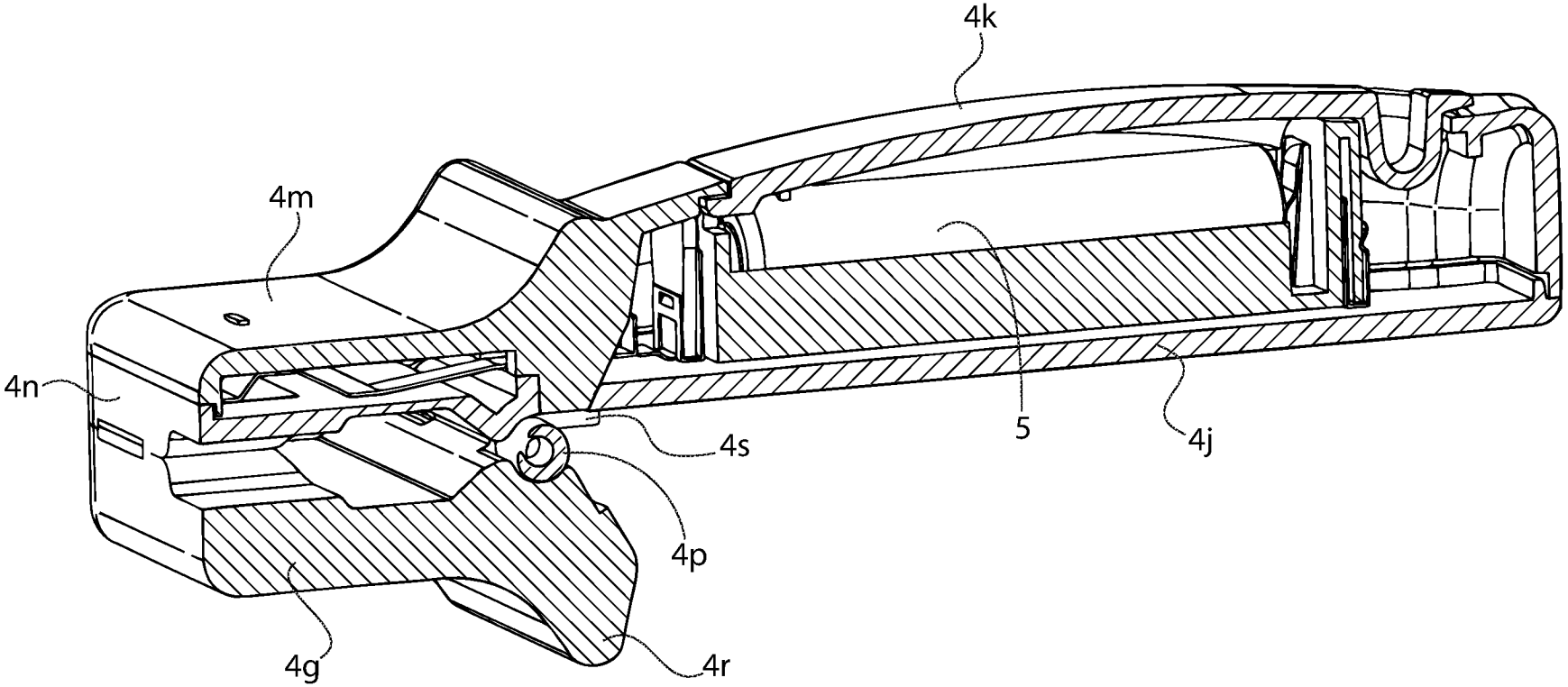
FIG. 10 is a cross sectional view of the power tongs of FIG. 8, except the jaws of the tongs are shown in an closed position.

FIG. 7 shows another embodiment of the electrical power leads that are designed to cooperate with the heating packette (1). Power tongs (4) are designed to clip onto the edge of the packette (1) and make electrical contact with the positive and negative terminals (2*a*', 2*b*', and possibly 2*a*, 2*b*) of the packette. The power tongs comprise a handle (4*h*), a stationary jaw (4*f*) and a spring loaded movable jaw (4*g*). The tongs are shown in more detail in FIGS. 8-10, and these will now be described.

The handle (4*h*) comprises a main body (4*i*), a base (4*j*), and a cover (4*k*). The main body, base and cover define a battery compartment (41) that is suitable to house one, two or more batteries in electrical series. The cover is preferably removable by a consumer, so that the batteries (5) may be replaced. The stationary jaw (4*f*) comprises an upper stationary jaw (4*m*) and a lower stationary jaw (4*n*). The lower stationary jaw has two holes (4*t*, 4*u*) through which protrude the power terminals (4*a*, 4*b*). The power terminals are positioned such that they are able to simultaneously make contact with the positive and negative terminals (2*a*', 2*b*') of the heating element (2') of the packette (1). By "stationary jaw" we mean that the jaw is stationary with respect to the main body (4*i*) of the handle (4*h*).

The main body (4*i*), the base (4*j*). and the upper stationary jaw (4*m*) may be assembled after being individually manufactured, or they may be of unitary construction. The lower stationary jaw (4*n*) is connected to the upper stationary jaw after the power leads (4*c*, 4*d*) have been assembled, as shown. All parts may be assembled by any suitable means, such snap fitments, adhesive or welding. Once assembled, the upper and lower stationary jaws form one composite jaw element, in which pass the power leads (4*c*, 4*d*) that are able to ferry electricity to and from the one or more batteries (5), and to and from the power terminals (4*a*, 4*b*). The one or more batteries are provided in the battery compartment (4*l*). When there is more than one battery, these are electrically connected in series via one or more jumpers (4*e*). The cathode (5*a*) and the anode (5*b*) of the battery (or of the batteries in series) have electrical contact with power leads (4*c*, 4*d*).

The movable jaw (4*g*) comprises a hinge (4*p*) that cooperates with hinge (4*q*) of the lower stationary jaw (4*n*). In the embodiment shown, a pin-type hinge is provided to connect the two parts in a movable articulation. A spring element (4*s*) is provided that biases the movable jaw against the lower stationary jaw, so that the edge of the heating packette (1) may be held firmly between the jaws. When this is done, then the power terminals (4*a*, 4*b*), which protrude through the holes (4*t*, 4*u*) of the a lower stationary jaw (4*n*), have physical contact with the positive and negative terminals (2*a*', 2*b*') of the pouch heating element (2').

Once contact is established between the power terminals (4*a*, 4*b*) and the positive and negative terminals (2*a*', 2*b*') of the packette heating element, a heating circuit is completed (i.e. closed) and electricity will flow from the batteries through the heating elements of the packette and back to the batteries. While this is happening, heat is generated and the interior of the packette is heated. When the jaws of the tongs are opened, and contact between the power terminals and heating element terminals is broken, the circuit is opened, and heating stops. The jaws of the tongs may be opened by applying finger pressure to the extension (4*r*) in the direction of the handle (4).

The power tongs are a relatively small, and of lightweight plastic and metal construction. The tongs are a handheld and portable device that is easy to use, thus making it possible to use a heating packette anywhere, even when mains power and a USB power connection are not available.

The Heating Element(s)

A heating element (2 or 2') of the present invention comprise one or more Flexible Printed Circuits. Flexible Printed Circuits (FPCs) are well known by persons skilled in the art. A basic FPC comprises a dielectric substrate as a base, an adhesive layer on top of the substrate, conductor elements arranged on the adhesive, and a protective layer over the circuit elements. Typical substrate materials include polyimide, polyester, polyethylene, fluorocarbon films, aromatic polyamide papers, composites and many others. The substrate may be curved and/or flexible.

Typical conductor materials include metal foils, such as copper and aluminum, and metal mixtures including stainless steel, beryllium-copper, phosphor-bronze, copper-nickel and nickel-chromium resistance alloys. However, one of the most cost effective methods of depositing conductor material onto a flexible substrate uses conventional ink printing techniques. Polymer thick film (PTF) inks may be applied to a substrate using various technologies known from conventional ink printing, such as screen printing, flexography, gravure, offset lithography, and inkjet printing. Printed PTF electronics is a comparatively low cost, high volume process. PTF inks are a mixture of a polymer binder (i.e. polyester, epoxy, acrylic) and a granulated conductive material such as silver, resistive carbon or both. The ink may be applied directly to the substrate without a separate adhesive. Although silver and carbon polymer thick-film (PTF) inks are the most common inorganic inks, various companies offer an assortment of other ink types, such silver chloride, silver carbon, platinum, gold, and phosphors. Organic ink types include conductive polymers such as poly(aniline) and poly(3,4-ethylene dioxitiophene), doped with poly(styrene sulfonate). Polymer semiconductors include poly(thiopene)s like poly(3-hexylthiophene) and poly(9,9-dioctylfluorene co-bithiophen). Those inks that when cured offer greater flexibility and scuff resistance are generally preferred.

Of particular note for the present invention are positive thermal coefficient (PTC) inks, such as PTC-614, PTC-842, PTC-921 and PTC-922 inks available from Conductive Compounds (Hudson, N.H.). These inks are suitable for low DC voltage applications, and are self-regulating, which means that once a certain temperature is reached, the ink is able to maintain a temperature range (for example, 45° C. to 50° C. or 50° C. to 60° C. or 60° C. to 70° C.) without a feedback loop.

One or more FPCs may be incorporated into the invention by adhering one or more prefabricated FPCs to one or more surfaces of the heating packette (1) using an adhesive. Examples of prefabricated FPCs include those manufactured by Minco (Minneapolis, Minn.) and those manufactured by Tempco (Wood Dale, Ill.). Alternatively, one or more FPCs may be printed directly onto one or more exterior surfaces of the packette. In either case, the FPC may be applied to the packette either before or after the top and bottom panels (1*a*, 1*b*) of the packette are bonded together with the mask inside. Preferably, however, the FPC is applied to the panel or panels prior to bonding them together.

In general, the substrate of a Flexible Printed Circuit may incorporate bulkier non-printed electronic elements. Technically speaking, there is nothing that prevents the incorporation of such elements in the printed circuit of the packette (1); it's a question of cost and convenience. Electronic elements that may be useful include thermistors, timers, voltage regulators, capacitors, resistors, LEDs, integrated circuit chips, logic gates, etc.

In preferred embodiments of the tongs (4), power is supplied by one or more batteries. Many types of battery may be used, as long as the battery can deliver the requisite power to achieve defined performance levels. Examples of battery types include: zinc-carbon (or standard carbon), alkaline, lithium, nickel-cadmium (rechargeable), nickel-metal hydride (rechargeable), lithium-ion, zinc-air, zinc-mercury oxide and silver-zinc chemistries. Common household batteries, such as those used in flashlights and smoke detectors, are frequently found in small handheld devices. These typically include what are known as AA, AAA, C, D and 9 volt batteries. Other batteries that may be appropriate are those commonly found in hearing aides and wrist watches. Furthermore, it is preferable if the battery is disposable in the ordinary household waste stream. Therefore, batteries which, by law, must be separated from the normal household waste stream for disposal (such as batteries containing mercury) are less preferred. As noted, the handle (4*h*) comprises a cover (4*k*) that provides access to the battery compartment (4*l*), so that the batteries are replaceable. Optionally, the batteries are rechargeable. To that end, either the batteries can be removed from the handle, as just described, or the exterior of the system can be provided with electric leads to the batteries, such that the system can be reposed in a charging base, so that power from the base is transmitted to and stored in the batteries.

For increased heating efficiency, each printed heating element (2) should cover an appreciable portion of the surface of the packette panels (1*a*, 1*b*). For example, as shown in FIG. 1, the heating element extends from one end of the packette (1) to the other, and from one side of the packette to the other.

In preferred embodiments, the time to heat a mask (10) to at least 50° C. is 3 minutes or less; more preferred is 2 minutes or less. Experience has shown that when energy is converted at a rate of 5 W to 10 W, then the temperature of a packette according to the present invention may be raised by at least 25° C. in the requisite time. Some USB specifications fix the voltage at 5 V±5% (4.75 V to 5.25 V). A common battery has a nominal voltage of 1.5 V or 3.0 V. If up to four of them are used, then a voltage of about 12 V is available. A packette of the present invention utilizes low voltage typically in the range of 1.5 V to 12 V. By adjusting the resistance of the heating element, the desired power conversion rate may be achieved. The electrical resistance of the heating element can be adjusted by the composition of the ink, by the amount of ink deposited, and by the cross sectional area of the deposited ink. A useful range of heating element resistance is about 1 Ω to about 15Ω; preferred is 2 Ω to 10Ω; more preferred is 3 Ω to 5Ω. For example, if the heating element resistance is between about 2.5 Ω and 5Ω, then a 5 V power supply produces a current of about 1 A to 2 A, and power is provided at about 5 W to 10 W. In one working embodiment of the packette (1), these parameters resulted in the packette being heated to 50° C. in 2-3 minutes. The self-regulating nature of the positive thermal coefficient ink used in this circuit prevented the temperature from increasing beyond about 50° C., even if the circuit is left on for an extended period of time.

Methods of Use

Figure 11:
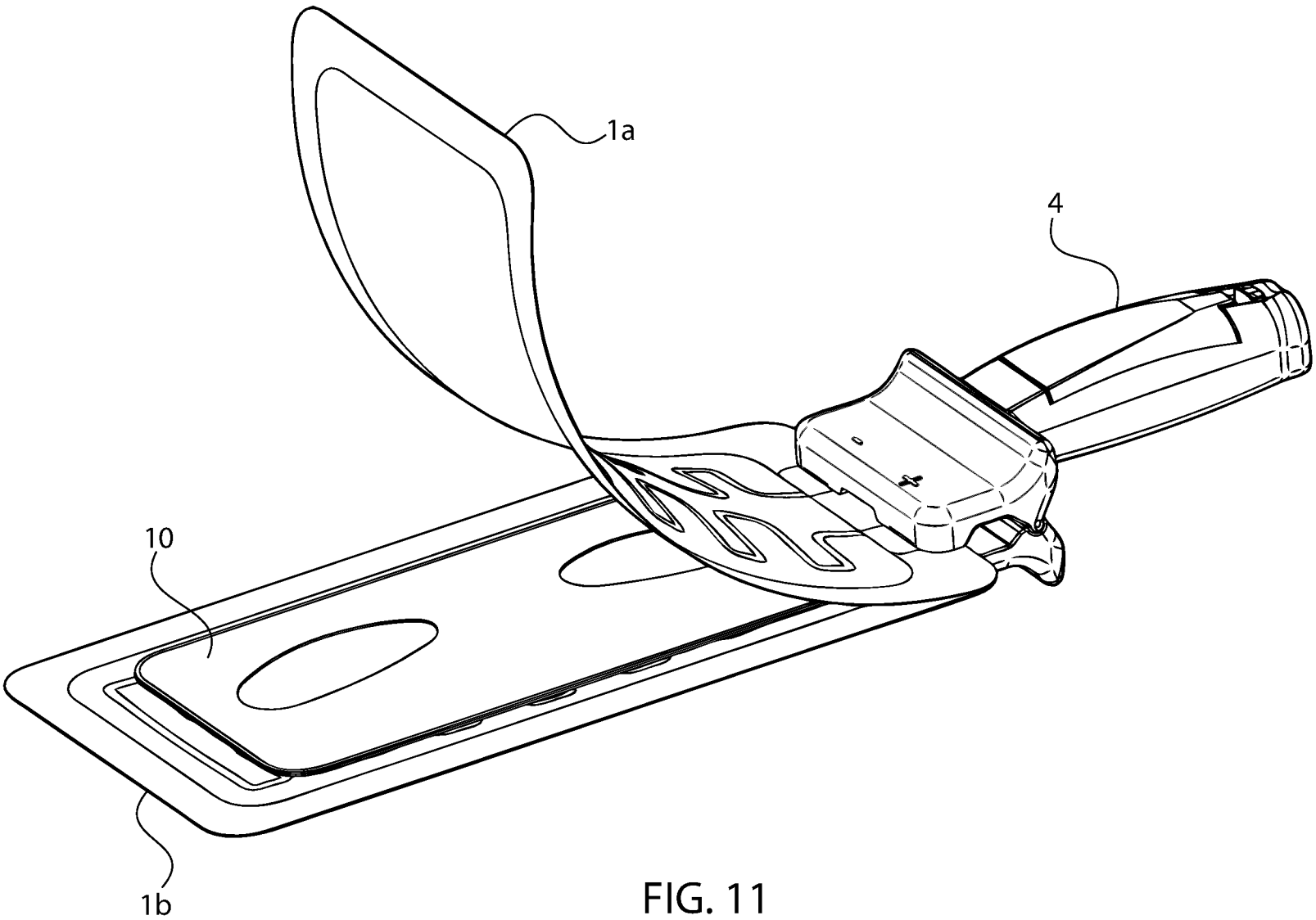
FIG. 11 depicts a resealable heating packette that has been opened during heating.

In use, a person having a packette (1) according to the present invention, that contains a mask (or wipe or towelette), places the packette into the grip of a power tongs (4), such that electrical contact is established between the positive and negative terminals (2*a*', 2*b*') of the heating element (2') and the power terminals (4*a*, 4*b*) of the tongs. The packette and tongs are allowed to remain connected for a time sufficient to heat the mask inside the packette to a desired application temperature. Thereafter, the packette is removed from the grip of the tongs, and opened. The heated mask is removed from the packette for use. Optionally, if the packette is semi-permanently sealed, then it is possible for a user to open the packette while the power tongs are still attached (see FIG. 11). This way, the user can touch the mask to see if it is sufficiently warm. If it is not, then the packette may be resealed and heating can continue.

Alternatively, a person having a packette (1) according to the present invention, that contains a mask (or wipe or towelette), applies the two metal clips (3*a*, 3*b*) of the USB power cable (3) to the positive and negative terminals (2*a*, 2*b*) of the heating element (2), as shown in the FIG. 4. The USB-type connector (3*c*) of the USB cable is inserted into a USB jack on a computer, automobile console, courtesy outlet on a bus or plane, or other device that can provide electric power, such that electricity flows through the heating element. Electricity is allowed to flow through the heating element for a time sufficient to heat the mask in the packette to a desired application temperature. Thereafter, the flow of electricity is stopped by removing the clips of the USB cable from the packette and/or removing the USB-type connector from the USB jack. The heating packette is opened, and the heated mask is removed from the packette for use.

Some Optional Features

In some preferred embodiments, a shut off timer is included to preserve the batteries, in case a user accidentally leaves the circuit closed beyond the time needed to heat the mask in the packette. Optionally, an indicator that tells the user when the application temperature is reached is included in the heating circuit. The indication may be incorporated into the packette (1) or into the power tongs (4). The indicator may be a light (such as an LED) that turns on or off when the product reaches a desired temperature or after a predetermined time. Another indicator may be a thermochromic material incorporated into the packette, that turns a certain color when a set temperature has been reached.

In some embodiments, the USB cable (3) as described herein is preferred. By connecting the USB cable to a device with internet or other network access, it may be possible to transfer data to and from the packette, as well as power. For example, the packette may be configured with an integrated circuit having programmed instructions. When the heating circuit is completed by plugging the USB plug into an internet enabled device, the coded instructions of the packette may pass to the device, to initiate all sorts of informational and media experiences normally associated with such devices. For example, when the USB plug is inserted into an internet enabled device, a web site may be launched having content that complements the use of the mask. For example, a video of a beauty advisor who offers advice and information about the use of one or more products may appear, or a promotional offer for a related product or service may be made. The experience can be interactive, so the user can identify which product she is sampling and the appropriate content can be downloaded the users device. The device must be able to provide sufficient power to heat the mask, and still run the device. As consumer electronics continue to improve, the number of electronic devices that are able supply the requisite power will only increase. In the process, the use of a conventional mask in packette has been transformed into a multi-sensory experience.

The power tongs (4) will be preferred anytime that USB power is not conveniently available. For example, when travelling or at an in-store cosmetics counter, the power tongs may be preferred. A counter salesperson can heat sample after sample for curious consumers without the need to plug the heating packette (1) into a computer. Likewise, access to USB power may not be convenient when travelling, but the battery powered tongs (4) are handheld and convenient.

FIG. 6 depicts a kit that embodies one method of marketing a heating system for a cosmetic mask according to the present invention. The kit comprises multiple packettes (1) containing a cosmetic mask. The packettes are stacked or otherwise reposed in a base (6), along with a USB-type cable (3) to be used in heating the masks. The base, stack of packettes and USB cable may be sold as a kit. Saleable kits that comprise at least seven packettes, or enough packettes for at least a one week supply of masks, are preferred. Optionally, the base may house a power source, such as one or more batteries. In this case, the base also comprises a USB jack (6*a*) that is able to draw power from the power source. Optionally, the kit of FIG. 6 may be fitted over with a cover (6*b*). Preferably, the cover is at least partially transparent. In this embodiment, the kit is completely self contained.

Figure 12:
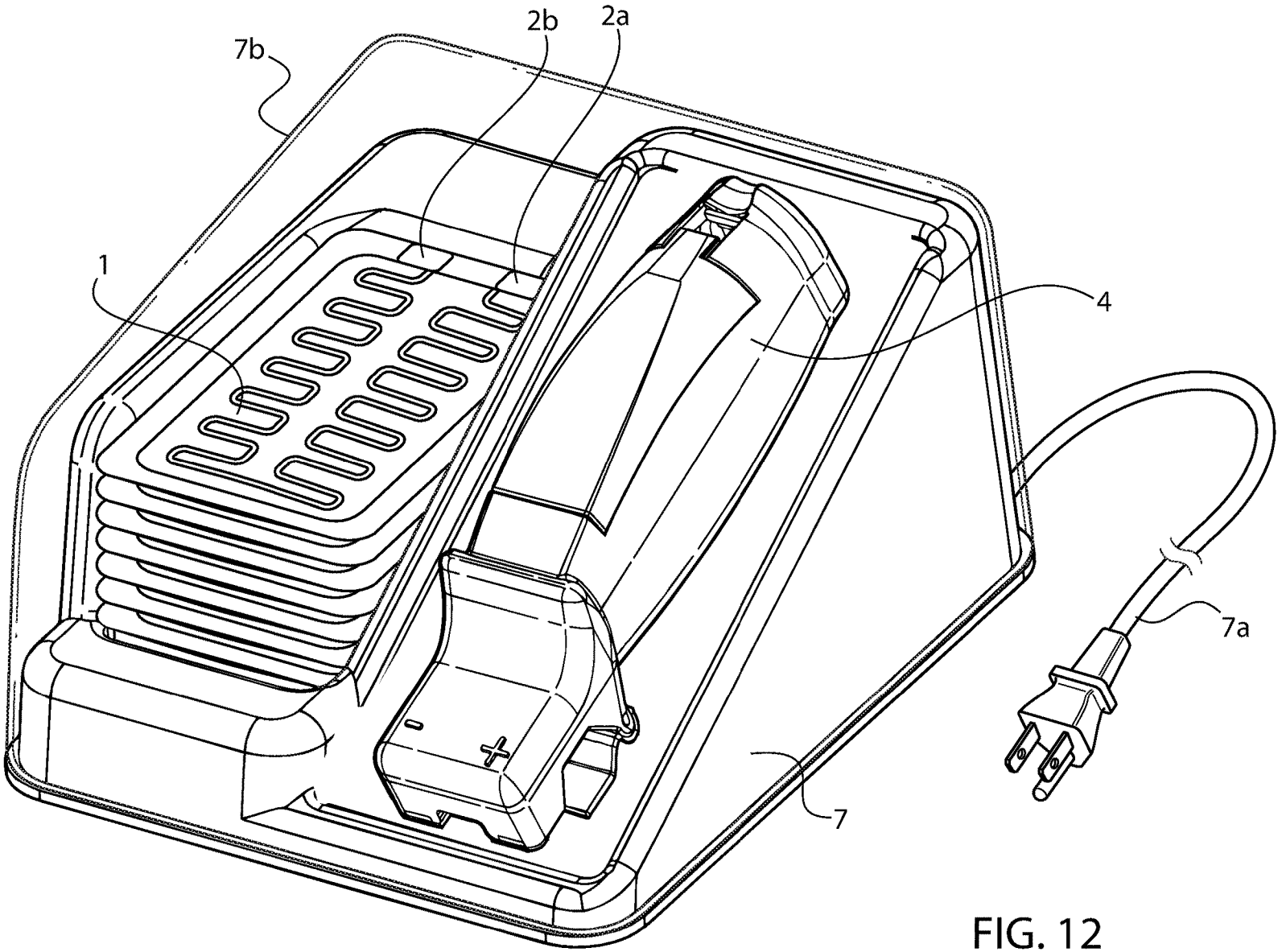
FIG. 12 depicts a kit that comprises multiple packettes containing a cosmetic mask, and a power tongs to be used in heating the masks.

FIG. 12 depicts a kit that embodies another method of marketing a heating system for a cosmetic mask according to the present invention. The kit comprises multiple packettes (1) containing a cosmetic mask. The packettes are stacked or otherwise reposed in a base (7), along with a power tongs (4) to be used in heating the masks. The base, stack of packettes and power tongs may be sold as a kit. Saleable kits comprising at least seven packettes are preferred. Optionally, the base serves as a recharging station for the power tongs. In this case, the base also comprises a power cord for (7*a*) that is able to draw power from a power mains, and electric leads that are able to convey power to the power tongs when the power tongs is reposed in the charging base. The kit of FIG. 12 may be fitted with a cover in a manner similar to the kit of FIG. 6.

What is claimed is:

1. A kit comprising:

A base, multiple heating packettes reposed in the base, and a power cable, wherein:

each heating packette comprises:

top and bottom panels having:

perimeter portions that are bonded together to form a reservoir between the two panels, the reservoir measuring 25 mm-150 mm by 25 mm-150 mm;

a fabric that is impregnated with a cosmetic or personal care preparation disposed in the reservoir; and at least one heating element that is in physical contact with at least one of the panels, wherein the heating element:

is a continuous resistive electric path that has a positive terminal and a negative terminal located near the perimeter portion of that panel on which the heating element is located;

has a resistance between 1Ω and 15Ω, and is able to convert electrical energy into heat at a rate of 5 watts to 10 watts; and comprises a positive thermal coefficient ink that is printed onto the exterior surface of the top or bottom panel; and the power cable has two metal clips at one end, and a USB-type connector at the other end for connecting a power source to the positive and negative terminals of one of the heating packettes, wherein the voltage of the power source is in the range of 1.5 V to 12 V;

wherein the heating packette is configured with an integrated circuit that has programmed instructions, and the USB-type power cable is able to transfer data to and from the packette.

2. The packette heating system of claim 1 wherein the top and bottom panels are 25μ to 100μ thick.

3. The kit of claim 1 wherein the base comprises a USB jack that is able to draw power from a power source housed within the base.

* * * * *